US010913289B2

(12) United States Patent
Mishima

(10) Patent No.: US 10,913,289 B2
(45) Date of Patent: Feb. 9, 2021

(54) THERMAL PRINTER AND PRINTING METHOD

(71) Applicant: Mitsubishi Electric Corporation, Tokyo (JP)

(72) Inventor: Megumi Mishima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/648,144

(22) PCT Filed: Jun. 3, 2019

(86) PCT No.: PCT/JP2019/021958
§ 371 (c)(1),
(2) Date: Mar. 17, 2020

(65) Prior Publication Data

US 2020/0384777 A1 Dec. 10, 2020

(51) Int. Cl.
*B41J 2/36* (2006.01)

(52) U.S. Cl.
CPC ..... *B41J 2/362* (2013.01)

(58) Field of Classification Search
CPC ..... B41J 2/36; B41J 2/362
See application file for complete search history.

(56) References Cited

U.S. PATENT DOCUMENTS 7,232,200 B2 * 6/2007 Nakahanada ..... B41J 29/393 347/19
9,975,365 B2 * 5/2018 Hwa ..... B41J 2/36
2001/0004284 A1 6/2001 Fukuda et al.
2007/0015659 A1 1/2007 O'Kell et al.
2014/0355016 A1 12/2014 Kondo
2015/0296095 A1 * 10/2015 Kawafuji ..... H04N 1/00801 358/474

FOREIGN PATENT DOCUMENTS

JP 10-291334 A 11/1998
JP 2012-236326 A 12/2012
JP 2018-176654 A 11/2018
WO WO 2004/103713 A1 12/2004

OTHER PUBLICATIONS

International Search Report issued in PCT/JP2019/021958 (PCT/ISA/210), dated Aug. 6, 2019.

* cited by examiner

*Primary Examiner* — Kristal Feggins
(74) *Attorney, Agent, or Firm* — Birch, Stewart, Kolasch & Birch, LLP

(57) ABSTRACT

When printing is performed using a thermal head to convert power into heat and to heat an ink sheet laid on paper by the heat, a change in density in a paper carrying direction D1 of an image to be printed in an output region of the paper is calculated using printing data, printing-data-for-correction to indicate an image-for-correction to be printed in a margin printing region of the paper and to cause a change of power required by the thermal head while a combined image including the image and the image-for-correction is printed onto the paper to be smaller than a change of the power required by the thermal head while only the image is printed onto the paper is created, and the ink sheet is heated by the thermal head in accordance with the printing data and the printing-data-for-correction.

9 Claims, 18 Drawing Sheets

IMAGE

IMAGES-FOR-CORRECTION

IMAGE AND IMAGES-FOR-CORRECTION (COMBINED IMAGE)

IMAGE

IMAGES-FOR-CORRECTION

IMAGE AND IMAGES-FOR-CORRECTION (COMBINED IMAGE)

IMAGE

IMAGES-FOR-CORRECTION

IMAGE AND IMAGES-FOR-CORRECTION (COMBINED IMAGE)

IMAGE

IMAGES-FOR-CORRECTION

IMAGE AND IMAGES-FOR-CORRECTION (COMBINED IMAGE)

THERMAL PRINTER AND PRINTING METHOD

TECHNICAL FIELD

The present invention relates to thermal printers and printing methods.

BACKGROUND ART

A thermal printer is fitted with paper and an ink sheet. Yellow (Y), magenta (M), and cyan (C) inks have been applied to the ink sheet.

The thermal printer includes a thermal head. The thermal head heats the ink sheet laid on the paper. This allows the inks having been applied to the ink sheet to sublimate and adhere to the paper. The inks are thus thermally transferred from the ink sheet to the paper, so that an image is printed onto the paper. The density of the printed image is adjusted by adjusting the amount of thermal energy emitted from the thermal head when the inks are thermally transferred from the ink sheet to the paper.

The thermal printer carries the paper and the ink sheet along the length of the paper in many cases. The thermal head includes a plurality of heating elements arranged along the width of the paper. The thermal printer calculates, from image data to be used to print an image, the amount of thermal energy required to thermally transfer the inks for each line of the image, and carries a current to each of the heating elements so that the calculated amount of thermal energy is emitted from the thermal head. The thermal printer thereby performs printing for each line of the image. The thermal printer performs printing so that Y, M, and C images are superimposed on one another to form a printed object to be output.

In a case where an image is printed by a thermal printer to perform printing for each line of the image as described above, the printed image can have a streaky density variation in a portion in which the density changes abruptly from a high density to a low density or from a low density to a high density. Such a streaky density variation is caused because, when printing is performed in the portion in which the density changes abruptly from the high density to the low density or from the low density to the high density, a current supplied to the thermal head to be carried to each of the heating elements changes abruptly, a voltage of a power supply to supply the current to the thermal head changes, and the change in voltage of the power supply causes a partial change in density of the printed image. For example, when printing is performed in the portion in which the density changes abruptly from the low density to the high density, the current supplied to the thermal head increases sharply, the voltage of the power supply decreases, and the density of the image partially decreases.

To suppress such a printing defect, correction of printing data used to print an image is proposed to suppress the change in current supplied to the thermal head and the change in voltage of the power supply.

In technology disclosed in Patent Document 1, for example, a grayscale value is transferred as dot data to a thermal head when pixel data is printed. Heating resistors arranged in the thermal head are selectively driven to be energized. Dyes on ink ribbons are thereby thermally transferred to paper. Pseudo dot pattern data is inserted immediately before the dot data of the grayscale value. While the pseudo dot pattern data is output, a voltage supplied to the thermal head is stabilized to thereby suppress a drop of the supplied voltage. A decrease in density value resulting from a decrease in voltage caused by a variation in value of a current supplied to the thermal head can thereby be suppressed (ABSTRACT).

PRIOR ART DOCUMENT

Patent Document

Patent Document 1: Japanese Patent Application Laid-Open No. 2012-236326

SUMMARY

Problem to be Solved by the Invention

In conventional technology, however, such correction to suppress the printing defect can adversely affect the quality of the image printed using the printing data.

The present invention has been conceived in view of the problem. A problem to be solved by the present invention is to provide a thermal printer and a printing method enabling suppression of a printing defect caused by an increase in change of power supplied to the thermal head and adverse effects of correction to suppress the printing defect on the quality of an image printed using printing data.

Means to Solve the Problem

The present invention is directed to a thermal printer.

The thermal printer includes a paper carrier, a thermal head, a density change calculation unit, and a printing-data-for-correction creation unit.

The paper carrier carries paper in a first direction.

The thermal head converts power into heat, and heats an ink sheet laid on the paper by the heat.

The density change calculation unit calculates, using printing data, a change in density in the first direction of an image to be printed in an output region of the paper. The output region remains in a printed object to be output.

The printing-data-for-correction creation unit creates printing-data-for-correction based on the change in density. The printing-data-for-correction is used to print an image-for-correction in a margin printing region of the paper. The margin printing region does not remain in the printed object to be output. The printing-data-for-correction causes a change of the power with printing location in the first direction while a combined image including the image and the image-for-correction is printed onto the paper to be smaller than a change of the power with printing location in the first direction while the image is printed onto the paper.

The thermal head heats the ink sheet in accordance with the printing data and the printing-data-for-correction.

The present invention is also directed to a printing method.

Effects of the Invention

According to the present invention, the change of the power supplied to the thermal head while the image is printed is reduced. A printing defect caused by an increase in change of power supplied to the thermal head can thereby be suppressed.

According to the present invention, it is unnecessary to correct the printing data itself to suppress the printing defect.

Adverse effects of correction to suppress the printing defect on the quality of the image printed using the printing data can thereby be suppressed.

The objects, features, aspects, and advantages of the present invention will become more apparent from the following detailed description and the accompanying drawings.

DESCRIPTION OF EMBODIMENTS

1 Embodiment 1

1.1 Printing Mechanism

Figure 1:
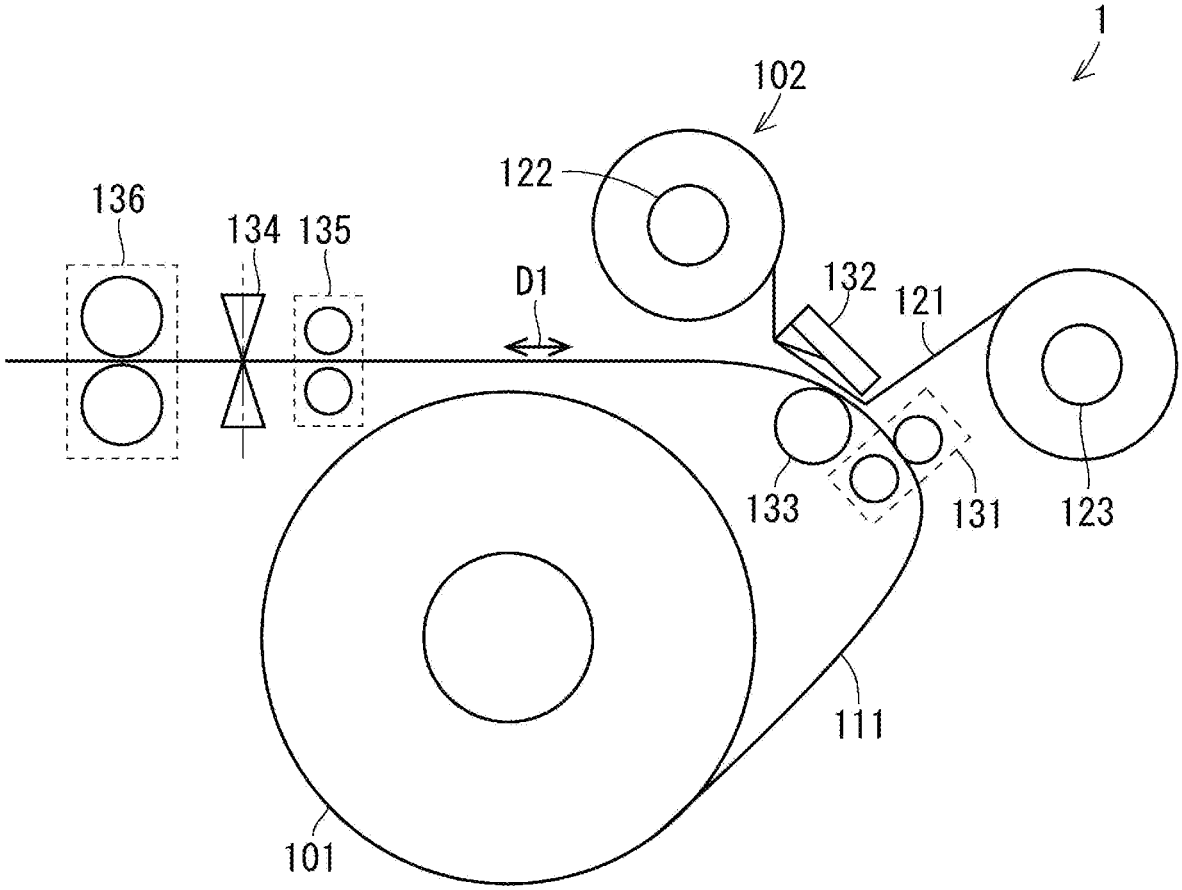
FIG. 1 is a schematic view schematically illustrating a printing mechanism of a thermal printer in each of Embodiments 1 to 3.

FIG. 1 is a schematic view schematically illustrating a printing mechanism of a thermal printer in Embodiment 1.

A thermal printer 1 illustrated in FIG. 1 is a heat sublimable printer.

The thermal printer 1 is fitted with a roll of paper 101 and an ink cassette 102.

The roll of paper 101 includes paper 111. The paper 111 is wound into a roll.

The ink cassette 102 includes an ink sheet 121, a feeding ink bobbin 122, and a rewinding ink bobbin 123.

The ink sheet 121 includes a film, a yellow (Y) ink layer, a magenta (M) ink layer, a cyan (C) ink layer, and an overprint (OP) material layer. The Y ink layer, the M ink layer, the C ink layer, and the OP material layer are disposed on the film. The number and types of layers of the ink sheet 121 may be changed.

One end along the length of the ink sheet 121 is wound around the feeding ink bobbin 122. The other end along the length of the ink sheet 121 is wound around the rewinding ink bobbin 123.

The thermal printer 1 includes a paper carrier 131, a thermal head 132, a platen roller 133, a cutter 134, a paper ejector 135, and a slitter 136.

The paper 111 withdrawn from the roll of paper 101 passes through the paper carrier 131, a gap between the thermal head 132 and the platen roller 133, the paper ejector 135, and the cutter 134 to reach the slitter 136.

The ink sheet 121 unwound from the feeding ink bobbin 122 passes through the gap between the thermal head 132 and the platen roller 133 to reach the rewinding ink bobbin 123, and is rewound by the rewinding ink bobbin 123.

The paper carrier 131 withdraws the paper 111 from the roll of paper 101, and carries the withdrawn paper 111 in a first direction D1. The first direction D1 is parallel to the length of the paper 111.

The thermal head 132 and the platen roller 133 crimp and heat the paper 111 and the ink sheet 121 laid on each other. A Y ink, an M ink, a C ink, and an OP material respectively contained in the Y ink layer, the M ink layer, the C ink layer, and the OP material layer of the ink sheet 121 are thereby thermally transferred from the ink sheet 121 to the paper 111, so that a Y image, an M image, a C image, and an OP are printed onto the paper 111.

The cutter 134 cuts the length of the paper 111 on which the Y image, the M image, the C image, and the OP are printed to form a piece of paper on which the Y image, the M image, the C image, and the OP are printed.

The slitter 136 further cuts the width of the formed piece of paper to form a printed object to be output.

The paper ejector 135 ejects the formed printed object.

1.2 Control System

Figure 2:
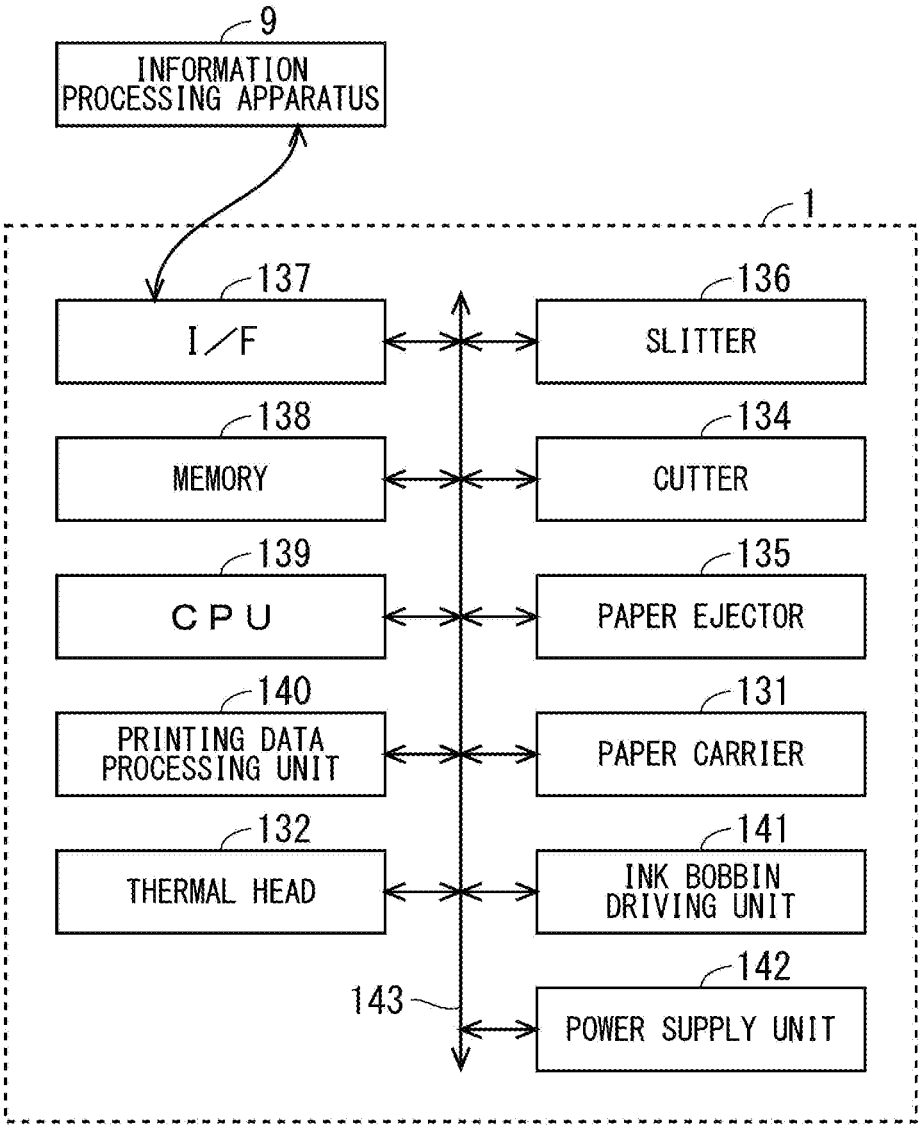
FIG. 2 is a block diagram showing a control system of the thermal printer in each of Embodiments 1 to 3.

FIG. 2 is a block diagram showing a control system of the thermal printer in Embodiment 1.

As shown in FIG. 2, the thermal printer 1 includes an interface (I/F) 137, memory 138, a CPU 139, a printing data processing unit 140, the thermal head 132, the slitter 136, the cutter 134, the paper ejector 135, the paper carrier 131, an ink bobbin driving unit 141, a power supply unit 142, and a data bus 143.

The I/F 137 receives image data and information on printing from an external information processing apparatus 9. The external information processing apparatus 9 is a personal computer or the like.

The memory 138 includes temporary memory and nonvolatile memory. The temporary memory temporarily stores the image data and the information on printing as received. The temporary memory is random access memory (RAM) or the like. The nonvolatile memory stores a control program, default values, and the like.

The printing data processing unit 140 processes the image data stored in the memory 138 to convert the image data stored in the memory 138 into printing data.

The CPU 139 processes data in accordance with the control program stored in the memory 138 to control the thermal printer 1 as a whole to thereby control printing performed by the thermal printer 1.

The ink bobbin driving unit 141 rotationally drives the feeding ink bobbin 122 and the rewinding ink bobbin 123. The ink bobbin driving unit 141 rotationally drives the feeding ink bobbin 122 and the rewinding ink bobbin 123 so that, when printing is performed onto the paper 111, the ink sheet 121 is fed from the feeding ink bobbin 122, the fed ink sheet 121 is carried together with the paper 111 and used for thermal transfer, and the ink sheet 121 having been used for thermal transfer is rewound by the rewinding ink bobbin 123.

The power supply unit 142 supplies power to the thermal head 132.

The data bus 143 serves as a transmission path of data transmitted by data communication performed among the I/F 137, the memory 138, the CPU 139, the printing data processing unit 140, the thermal head 132, the slitter 136, the cutter 134, the paper ejector 135, the paper carrier 131, the ink bobbin driving unit 141, and the power supply unit 142.

1.3 Thermal Head

Figure 3:
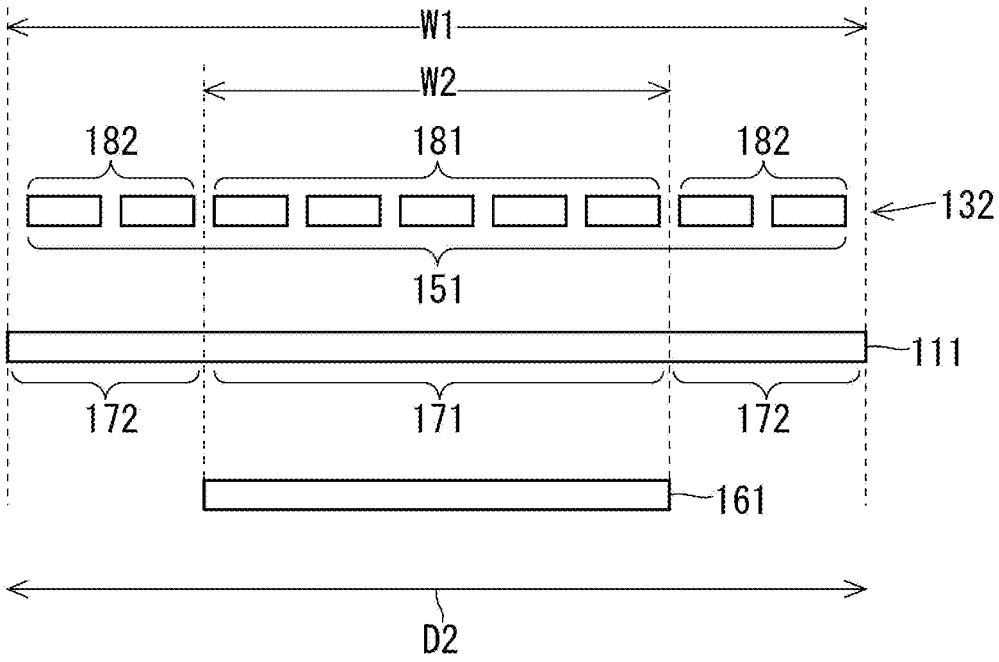
FIG. 3 is a schematic view schematically illustrating a thermal head of the thermal printer in each of Embodiments 1 to 3.

FIG. 3 is a schematic view schematically illustrating the thermal head of the thermal printer in Embodiment 1.

As illustrated in FIG. 3, the thermal head 132 includes a plurality of heating elements 151. The heating elements 151 are arranged in a second direction D2. The second direction D2 is parallel to the width of the paper 111. The second direction D2 is thus perpendicular to the first direction D1. The heating elements 151 are arranged over a range having a width W1 greater than a width W2 of a printed object 161 to be output. The heating elements 151 thus includes heating elements 181 used to print an image in an output region 171 of the paper 111 remaining in the printed object 161 to be output and heating elements 182 used to print images-for-correction in margin printing regions 172 of the paper 111 not remaining in the printed object 161 to be output. In a case where the heating elements 151 have a density of 300 dpi (dot per inch) and correspond to 2000 dots, and the printed object 161 to be output has a width W2 of 127 mm, for example, the heating elements 181 used to print the image in the output region 171 correspond approximately to 1500 dots, and the heating elements 182 used to print the images-for-correction in the margin printing regions 172 correspond approximately to 500 dots. The output region 171 is located in the middle in the second direction D2. The margin printing regions 172 are located on the periphery in the second direction D2. The margin printing regions 172 are thus located in the second direction D2 as viewed from the output region 171.

1.4 Basic Printing Operation

In a case where the image data and the information on printing are transmitted from the external information processing apparatus 9 to the thermal printer 1, the I/F 137 receives the image data and the information on printing as transmitted. The memory 138 stores the image data and the information on printing as received. The CPU 139 performs image processing on the stored image data. The image processing includes enlargement or reduction, image quality correction, and the like performed so that the size of an image to be printed matches the size of the printed object 161 to be output. The printing data processing unit 140 converts the image data on which the image processing has been performed into the printing data. The paper carrier 131 withdraws the paper 111 from the roll of paper 101, and carries the withdrawn paper 111 to the gap between the thermal head 132 and the platen roller 133. The thermal head 132 and the platen roller 133 crimp and heat the paper 111 and the ink sheet 121 laid on each other. In this case, the thermal head 132 heats the ink sheet 121 in accordance with the printing data. While the thermal head 132 heats the ink sheet 121 in accordance with the printing data, the paper carrier 131 carries the paper 111. Carrying of the paper 111 is performed each time the Y image, the M image, the C image, or the OP is printed thereby being performed repeatedly. The Y image, the M image, the C image, and the OP are thereby superimposed on one another to be printed onto the paper 111. The cutter 134 cuts the paper 111 on which the Y image, the M image, the C image, and the OP are printed to form the piece of paper having a predetermined length. The predetermined length is 89 mm in a case where the printed object 161 to be output has an L size, for example. The slitter 136 cuts the formed piece of paper to form the printed object 161 having a predetermined width. The predetermined width is 127 mm in a case where the printed object 161 to be output has the L size, for example. The paper ejector 135 ejects the formed printed object 161 to the outside of the thermal printer 1.

1.5 Printing Data Processing Unit

Figure 4:
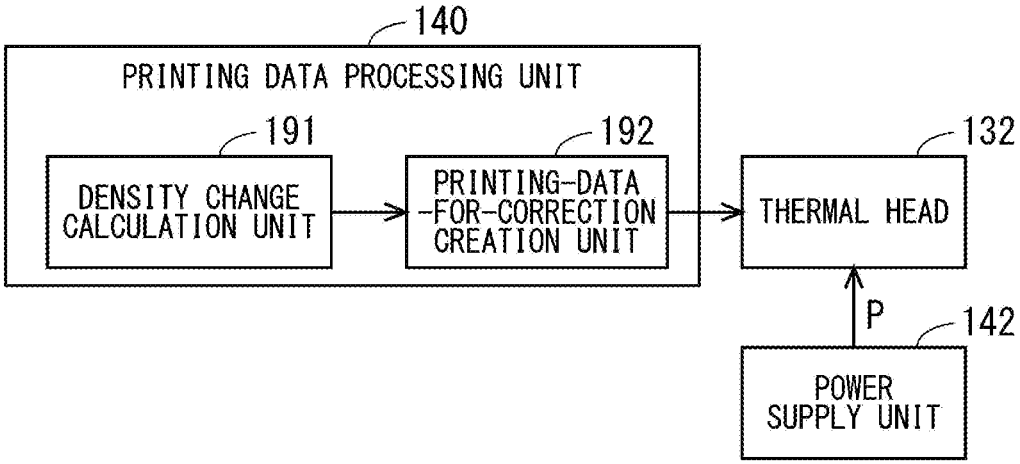
FIG. 4 is a block diagram showing a printing data processing unit, the thermal head, and a power supply unit of the thermal printer in each of Embodiments 1 to 3.

FIG. 4 is a block diagram showing the printing data processing unit, the thermal head, and the power supply unit of the thermal printer in Embodiment 1.

As shown in FIG. 4, the printing data processing unit 140 includes a density change calculation unit 191 and a printing-data-for-correction creation unit 192.

The power supply unit 142 supplies power P to the thermal head 132. The thermal head 132 is thereby provided with energy to be converted into heat.

The thermal head 132 converts the supplied power P into heat. The thermal head 132 heats the ink sheet 121 laid on the paper 111 by the heat.

The density change calculation unit 191 calculates, using the printing data, a change in density in the first direction D1 of the image to be printed in the output region 171 of the paper 111.

The printing-data-for-correction creation unit 192 creates, based on the calculated change in density, printing-data-for-correction to be used to print the images-for-correction in the margin printing regions 172 of the paper 111. In this case, the printing-data-for-correction creation unit 192 creates the printing-data-for-correction to cause a first change of the power P with printing location in the first direction D1 while a combined image including the image and the images-for-correction is printed onto the paper 111 to be smaller than a second change of the power P with printing location in the first direction D1 while only the image is printed onto the paper 111.

The thermal head 132 heats the ink sheet 121 in accordance with the printing data and the printing-data-for-correction. The image is thereby printed in the output region 171 of the paper 111. The images-for-correction are printed in the margin printing regions 172 of the paper 111.

1.6 Examples of Image, Images-for-Correction, and Power P

Figure 5A:
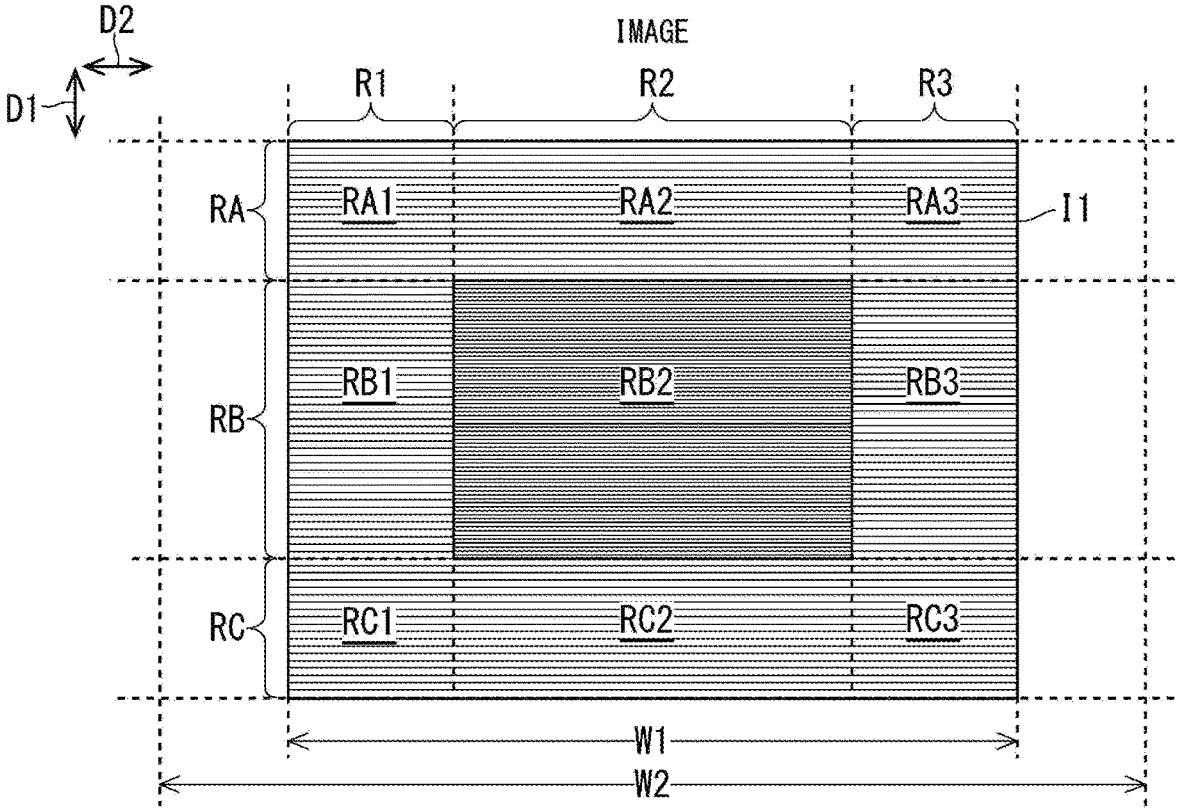
FIG. 5A illustrates an example of an image printed by the thermal printer in Embodiment 1.
Figure 5B:
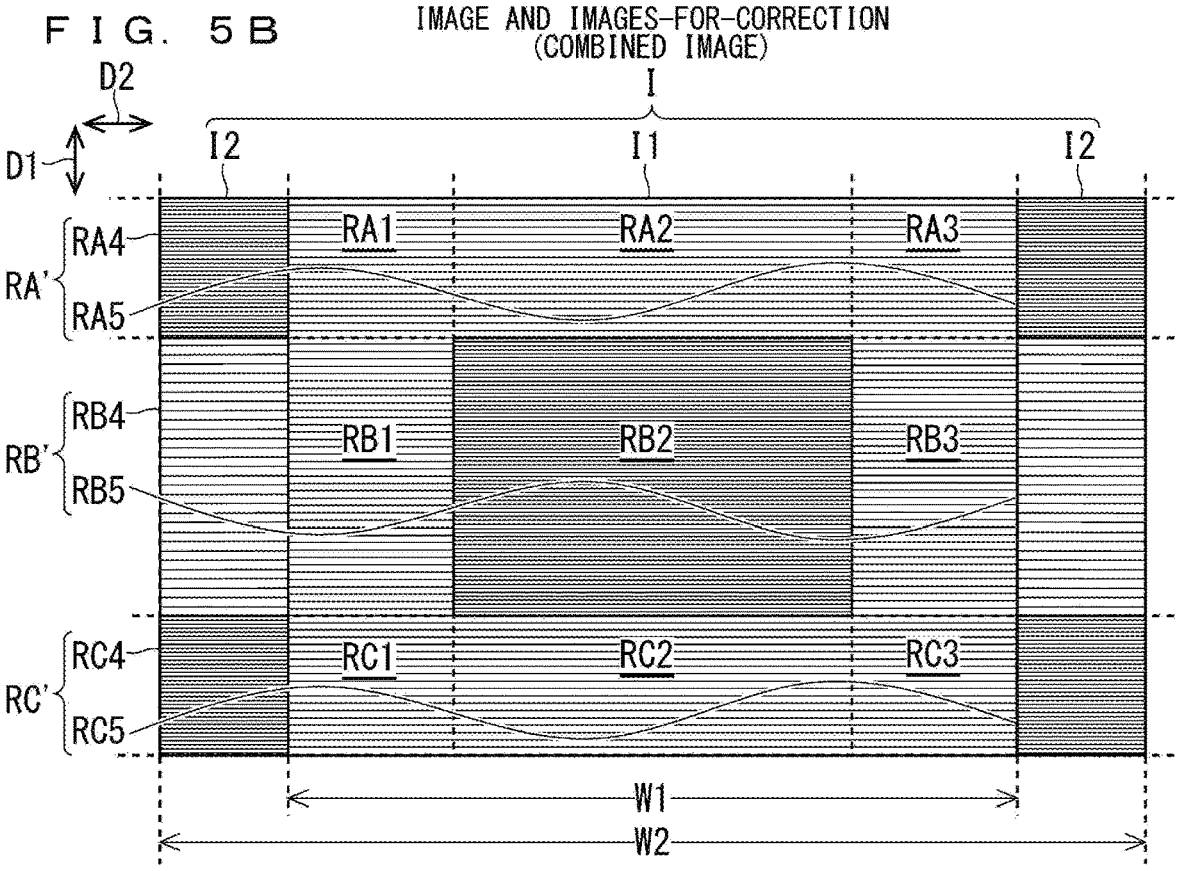
FIG. 5B illustrates an example of a combined image printed by the thermal printer in Embodiment 1.
Figure 6A:
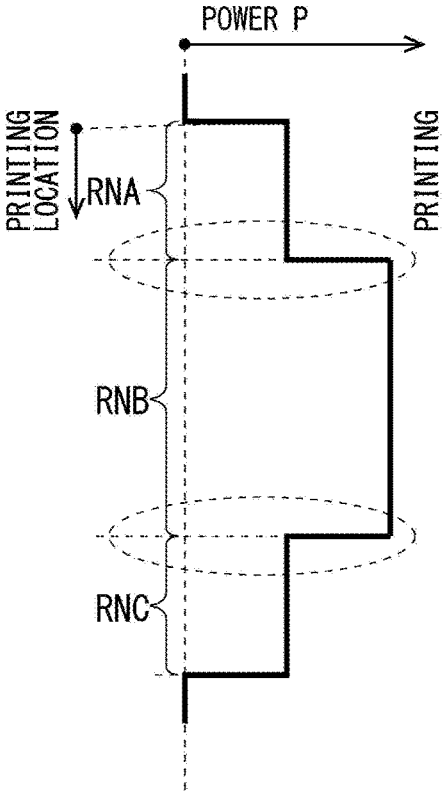
FIG. 6A shows a graph showing an example of a change of power supplied to the thermal head with printing location in a first direction while the image is printed by the thermal printer in Embodiment 1.
Figure 6B:
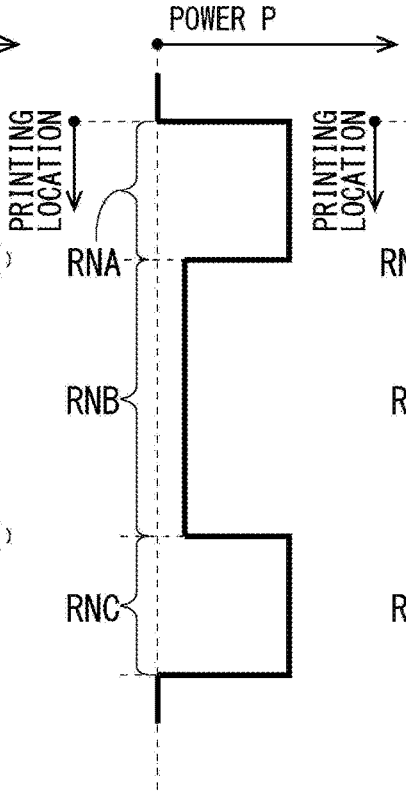
FIG. 6B shows a graph showing an example of a change of power supplied to the thermal head with printing location in a first direction while images-for-correction are printed by the thermal printer in Embodiment 1.
Figure 6C:
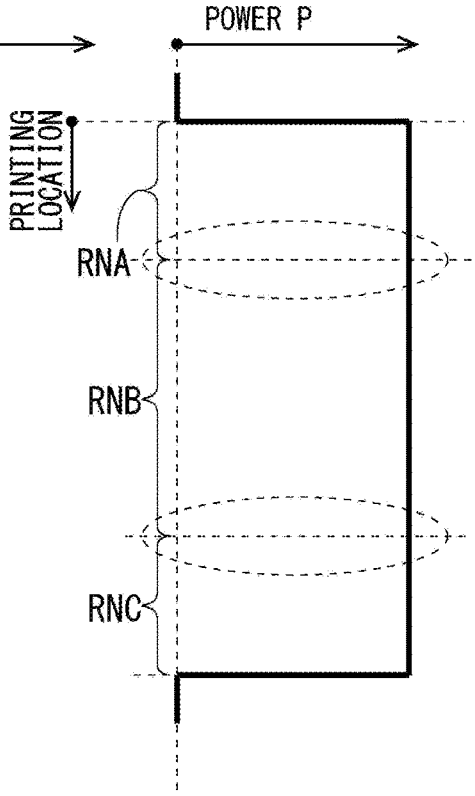
FIG. 6C shows a graph showing an example of a change of power supplied to the thermal head with printing location in a first direction while the combined image is printed by the thermal printer in Embodiment 1.

FIG. 5A illustrates an example of the image printed by the thermal printer in Embodiment 1. FIG. 5B illustrates an example of the combined image including the image and the images-for-correction printed by the thermal printer in Embodiment 1. FIG. 6A is a graph showing an example of the change of the power supplied to the thermal head with printing location in the first direction while only the image is printed by the thermal printer in Embodiment 1. FIG. 6B is a graph showing an example of the change of the power supplied to the thermal head with printing location in the first direction while only the images-for-correction are printed by the thermal printer in Embodiment 1. FIG. 6C is a graph showing an example of the change of the power supplied to the thermal head with printing location in the first direction while the combined image including the image and the images-for-correction is printed by the thermal printer in Embodiment 1. In each of FIGS. 6A, 6B, and 6C, the vertical axis represents the printing location in the first direction, and the horizontal axis represents the power P supplied to the thermal head. The power P supplied to the thermal head is power supplied to the thermal head while each line extending in the second direction is printed.

An image I1 illustrated in FIG. 5A is printed in the output region 171 of the paper 111.

The image I1 includes regions RA, RB, and RC. The regions RA, RB, and RC are located in ranges different in the first direction D1.

The region RA includes regions RA1, RA2, and RA3 each having a relatively low density. The regions RA1, RA2, and RA3 are located in ranges different in the second direction D2.

The region RB includes regions RB1 and RB3 each having a relatively low density and a region RB2 having a relatively high density. The regions RB1, RB2, and RB3 are located in ranges different in the second direction D2.

The region RC includes regions RC1, RC2, and RC3 each having a relatively low density. The regions RC1, RC2, and RC3 are located in ranges different in the second direction D2.

Each of the regions RA1, RA2, RA3, RB1, RB2, RB3, RC1, RC2, and RC3 has a uniform density.

A region R1 including the regions RA1, RB1, and RC1 does not have a significant change in density. A region R2 including the regions RA2, RB2, and RC2 has a significant change in density from a low density to a high density at the boundary between the regions RA2 and RB2, and has a significant change in density from a high density to a low density at the boundary between the regions RB2 and RC2. A region R3 including the regions RA3, RB3, and RC3 does not have a significant change in density.

In the change of the power P supplied to the thermal head 132 with printing location in the first direction D1 while only the image I1 is printed as illustrated in FIG. 6A, the power P supplied to the thermal head 132 is relatively small in ranges RNA and RNC in which printing is performed in the regions RA and RC, and is relatively large in a range RNB in which printing is performed in the region RB.

The image I1 included in a combined image I illustrated in FIG. 5B is the image I1 illustrated in FIG. 5A, and is printed in the output region 171. Images-for-correction I2 included in the combined image I illustrated in FIG. 5B are printed in the margin printing regions 172.

The images-for-correction I2 include regions RA', RB', and RC'.

The regions RA', RB', and RC' are located in ranges different in the first direction D1, and are located in the second direction D2 as viewed from the regions RA, RB, and RC.

The region RA' includes regions RA4 and RA5 each having a relatively high density.

The region RB' includes regions RB4 and RB5 each having a relatively low density.

The region RC' includes regions RC4 and RC5 each having a relatively high density.

With these configurations, printing is performed simultaneously in the region RA of the image I1 having a relatively low density and in the region RA' of the images-for-correction I2 having a relatively high density. Printing is also performed simultaneously in the region RB of the image I1 having a relatively high density and in the region RB' of the images-for-correction I2 having a relatively low density. Printing is also performed simultaneously in the region RC of the image I1 having a relatively low density and in the region RC' of the images-for-correction I2 having a relatively high density. The change of the power P supplied to the thermal head 132 with printing location in the first direction D1 while the image I1 and the images-for-correction I2 are printed is thereby reduced.

In the change of the power P supplied to the thermal head 132 with printing location in the first direction D1 while only the images-for-correction I2 are printed as illustrated in FIG. 6B, the power P supplied to the thermal head 132 is relatively large in the ranges RNA and RNC in which printing is performed in the regions RA' and RC', and is relatively small in the range RNB in which printing is performed in the region RB'.

The change of the power P supplied to the thermal head 132 with printing location in the first direction D1 while the combined image I is printed as illustrated in FIG. 6C is the sum of the change of the power P supplied to the thermal head 132 with printing location in the first direction D1 while only the image I1 is printed as illustrated in FIG. 6A and the change of the power P supplied to the thermal head 132 with printing location in the first direction D1 while only the images-for-correction I2 are printed as illustrated in FIG. 6B. In the change of the power P supplied to the thermal head 132 with printing location in the first direction D1 while the combined image I is printed as illustrated in FIG. 6C, the power P supplied to the thermal head 132 is constant.

1.7 Operation

Figure 7:
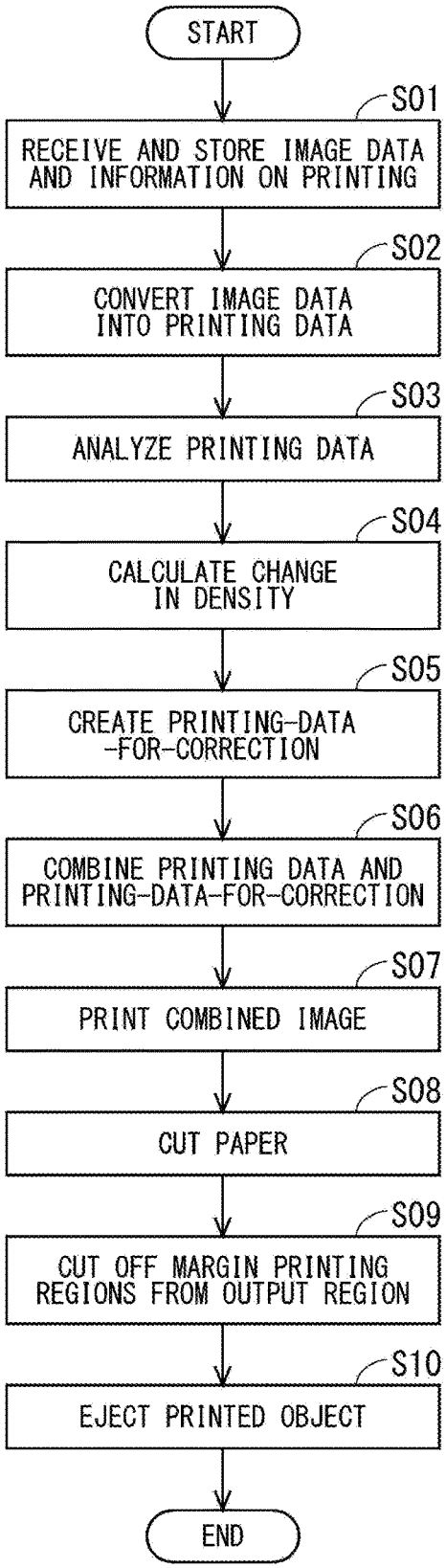
FIG. 7 is a flowchart showing operation of the thermal printer in each of Embodiments 1 and 2.

FIG. 7 is a flowchart showing operation of the thermal printer in Embodiment 1.

The thermal printer 1 sequentially performs steps S01 to S10 shown in FIG. 7 when performing printing onto the paper 111.

In the step S01, the I/F 137 receives the image data and the information on printing from the external information processing apparatus 9. The memory 138 stores the image data and the information on printing as received.

In the next step S02, the CPU 139 performs image processing on the stored image data. The printing data processing unit 140 converts the image data on which the image processing has been performed into the printing data to create the printing data.

In the next step S03, the density change calculation unit 191 analyzes the created printing data.

In the next step S04, the density change calculation unit 191 calculates, based on the result of analysis, the change in density in the first direction D1 of the image I1 to be printed using the created printing data. The density change calculation unit 191 calculates a difference between the density in the region RA of the image I1 and the density in the region RB of the image I1 and a difference between the density in the region RB of the image I1 and the density in the region RC of the image I1.

In the next step S05, the printing-data-for-correction creation unit 192 creates the printing-data-for-correction based on the calculated change in density. The printing-data-for-correction creation unit 192 calculates, based on the calculated differences in density, a difference between the density in the region RA' of the images-for-correction I2 and the density in the region RB' of the images-for-correction I2 and a difference between the density in the region RB' of the images-for-correction I2 and the density in the region RC' of the images-for-correction I2 to create the printing-data-for-correction. In this case, the printing-data-for-correction creation unit 192 calculates, for each line of the image I1, the power P supplied to the thermal head 132 while the image I1 is printed onto the paper 111 using the printing data. The printing-data-for-correction creation unit 192 also calculates, for each line of the combined image I, the power P supplied to the thermal head 132 while the combined image I is printed onto the paper 111 using the printing data and the printing-data-for-correction. The printing-data-for-correction creation unit 192 creates the printing-data-for-correction to cause the first change of the power P supplied to the thermal head 132 with printing location in the first direction D1 while the combined image I is printed onto the paper 111 to be smaller than the second change of the power P supplied to the thermal head 132 with printing location in the first direction D1 while only the image I1 is printed onto the paper 111. The first change is caused to be smaller than the second change by maintaining the power P supplied to the thermal head 132 while the combined image I is printed onto the paper 111 constant, as illustrated in FIG. 6C.

The created printing-data-for-correction and the printed images-for-correction I2 may be changed as long as the first change becomes smaller than a set change, and becomes smaller than the second change.

In the next step S06, the printing-data-for-correction creation unit 192 combines the printing data and the printing-data-for-correction as created.

In the process of creating the printing data and the printing-data-for-correction, and combining the printing data and the printing-data-for-correction as created, the printing data itself is not corrected. Instead, the printing-data-for-correction creation unit 192 creates the printing-data-for-correction to be used to print the images-for-correction I2 in the margin printing regions 172 of the paper 111 not remaining in the printed object 161 to be output.

In the next step S07, the thermal head 132 heats the ink sheet 121 in accordance with the printing data and the printing-data-for-correction as combined. The combined image I including the image I1 and the images-for-correction I2 is thereby printed onto the paper 111.

In the next step S08, the cutter 134 cuts the paper 111 on which the combined image I is printed to form the piece of paper on which the combined image I is printed and which has the predetermined length.

Figure 8:
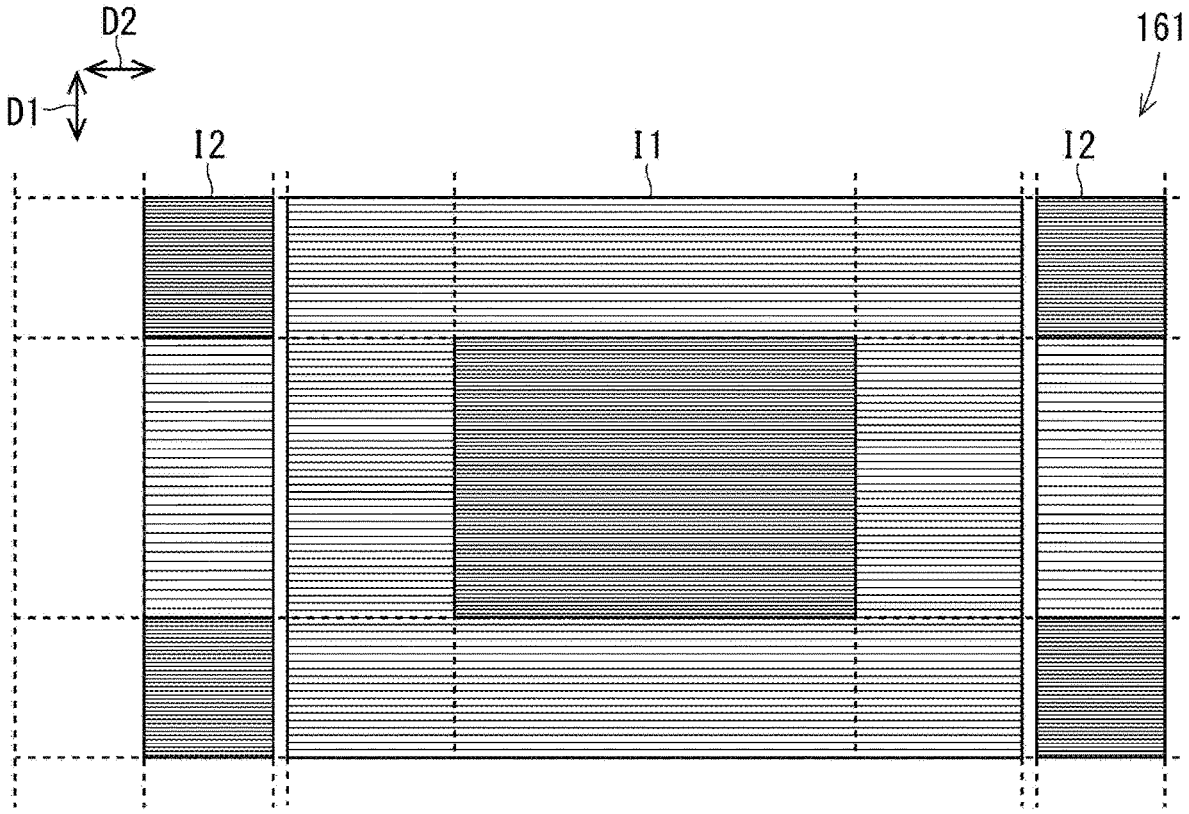
FIG. 8 illustrates examples of the image printed on a printed object to be output from the thermal printer in Embodiment 1 and the images-for-correction.

FIG. 8 illustrates examples of the image printed on the printed object to be output from the thermal printer in Embodiment 1 and the images-for-correction.

In the next step S09, the slitter 136 cuts off the margin printing regions 172 not remaining in the printed object 161 to be output from the output region 171 remaining in the printed object 161 to be output to divide the image I1 and the images-for-correction I2 from each other as illustrated in FIG. 8 to thereby form the printed object 161. In this case, the slitter 136 cuts the paper 111 to divide the paper 111 in the second direction D2.

In the next step S10, the paper ejector 135 ejects the formed printed object 161 to the outside of the thermal printer 1.

1.8 Effects of Invention in Embodiment 1

Figure 18:
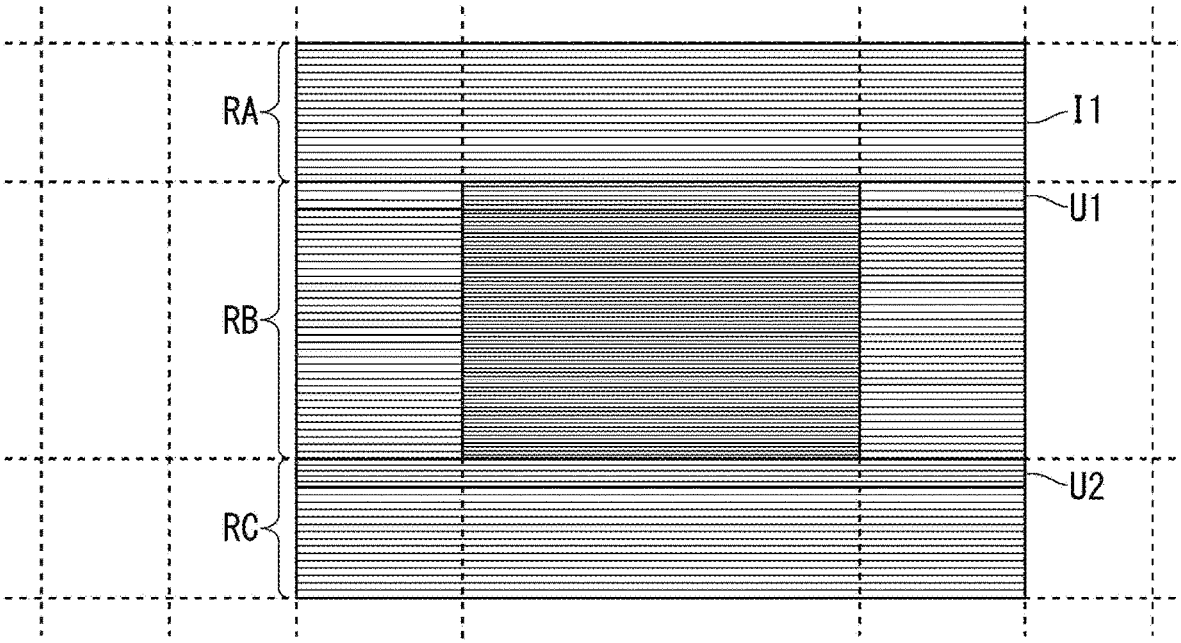
FIG. 18 illustrates an example of an image printed by a conventional thermal printer.

FIG. 18 illustrates an example of an image printed by a conventional thermal printer.

The image I1 illustrated in FIG. 18 includes a portion having a significant change in density from a low density to a high density at the boundary between the regions RA and RB. The image I1 also includes a portion having a significant change in density from a high density to a low density at the boundary between the regions RB and RC. Owing to these portions, the image I1 has a white streaky density variation U1 having a density lower than that in its surroundings at or around the boundary between the regions RA and RB. The image I1 also has a black streaky density variation U2 having a density higher than that in its surroundings at or around the boundary between the regions RB and RC.

According to the invention in Embodiment 1, however, the change of the power P supplied to the thermal head 132 while the image I1 is printed is reduced. This can suppress a printing defect, such as the density variations U1 and U2, caused by an increase in change of the power P supplied to the thermal head 132.

Furthermore, according to the invention in Embodiment 1, it is unnecessary to correct the printing data itself to suppress the printing defect. This can suppress the adverse effects of correction to suppress the printing defect on the quality of the image I1 printed using the printing data.

2 Embodiment 2

2.1 Difference Between Embodiments 1 and 2

FIG. 1 is also a schematic view schematically illustrating a printing mechanism of a thermal printer in Embodiment 2. FIG. 2 is also a block diagram showing a control system of the thermal printer in Embodiment 2. FIG. 3 is also a schematic view schematically illustrating a thermal head of the thermal printer in Embodiment 2. FIG. 4 is also a block diagram showing a printing data processing unit, the thermal head, and a power supply unit of the thermal printer in Embodiment 2. FIG. 7 is also a flowchart showing operation of the thermal printer in Embodiment 2.

Embodiment 2 differs from Embodiment 1 mainly in configuration described below. As for configuration not described below, similar configuration to that used in Embodiment 1 is used in Embodiment 2.

In Embodiment 1, the printing-data-for-correction creation unit 192 calculates the printing-data-for-correction to maintain the power P supplied to the thermal head 132 while the combined image I is printed onto the paper 111 constant. In contrast, in Embodiment 2, the printing-data-for-correction creation unit 192 calculates the printing-data-for-correction to reduce the change of the power P supplied to the thermal head 132 while the combined image I is printed onto the paper 111 to the extent that no density variations of the combined image I are caused. The power P is not necessarily constant.

Figure 9A:
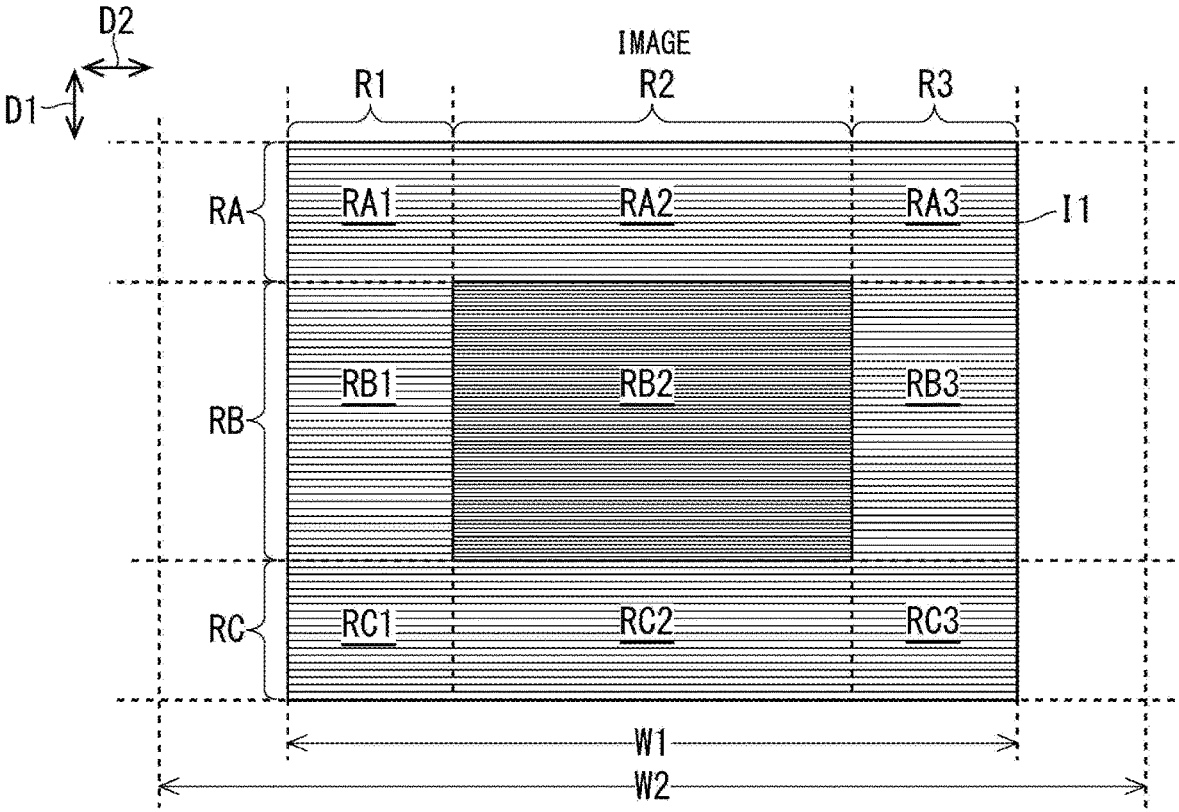
FIG. 9A illustrates an example of an image printed by the thermal printer in Embodiment 2.
Figure 9B:
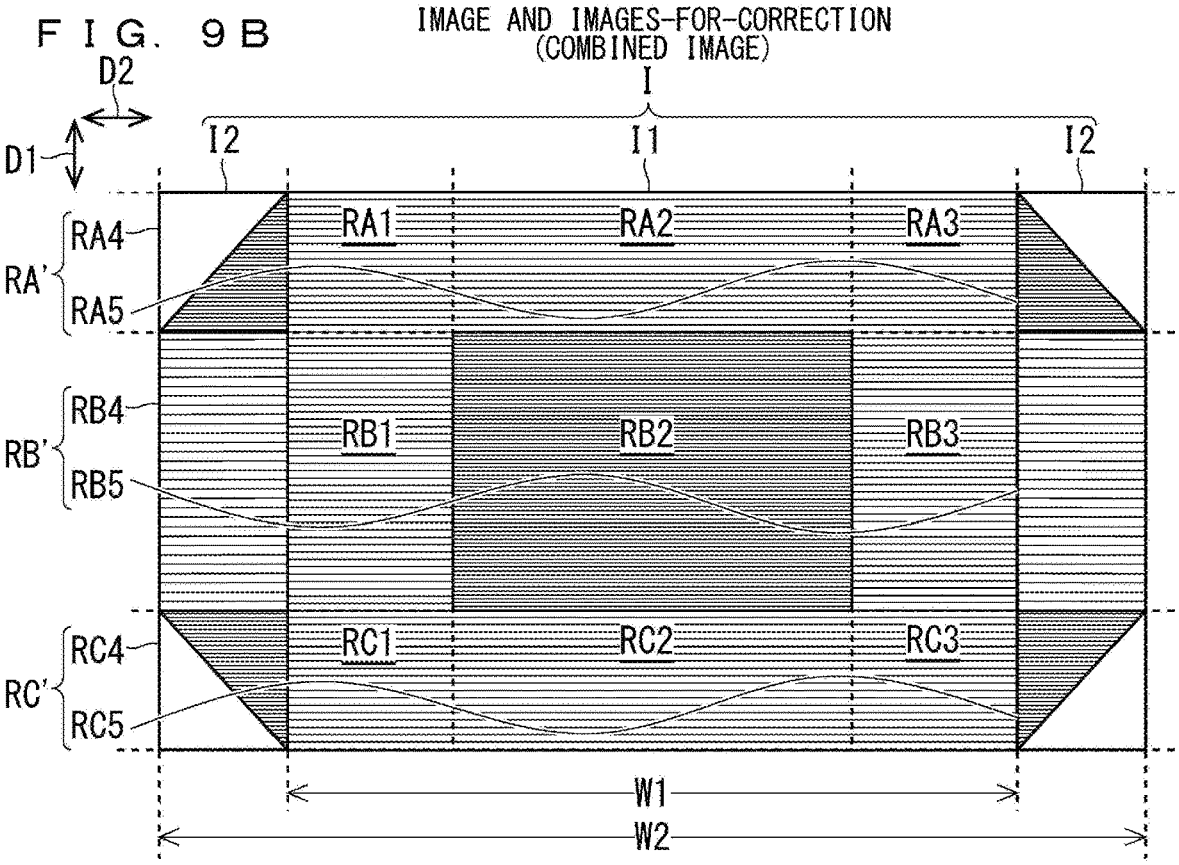
FIG. 9B illustrates an example of a combined image printed by the thermal printer in Embodiment 2.
Figure 10A:
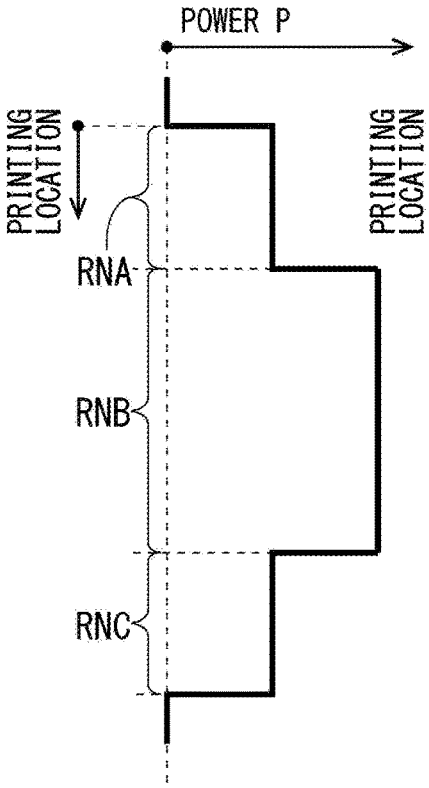
FIG. 10A shows a graph showing an example of the change of the power supplied to the thermal head with printing location in the first direction while the image is printed by the thermal printer in Embodiment 2.
Figure 10B:
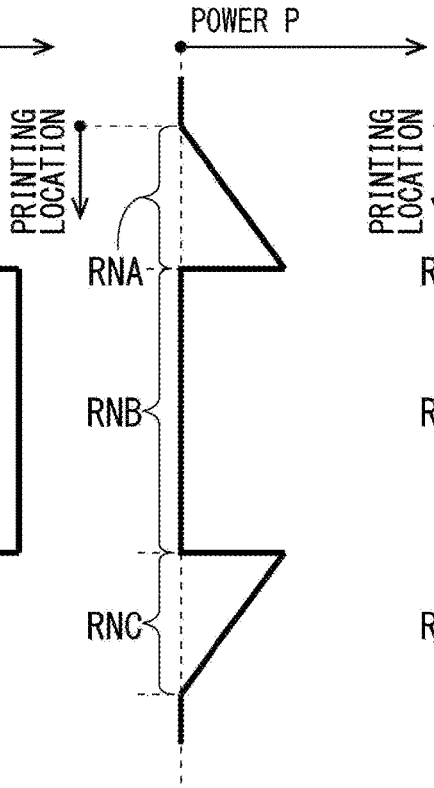
FIG. 10B shows a graph showing an example of the change of the power supplied to the thermal head with printing location in the first direction while images-for-correction are printed by the thermal printer in Embodiment 2.
Figure 10C:
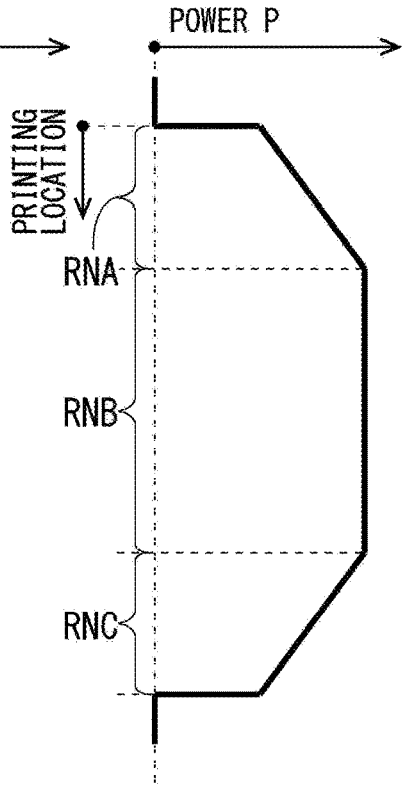
FIG. 10C shows a graph showing an example of the change of the power supplied to the thermal head with printing location in the first direction while the combined image is printed by the thermal printer in Embodiment 2.

FIG. 9A illustrates an example of an image printed by the thermal printer in Embodiment 2. FIG. 9B illustrates an example of a combined image including the image and images-for-correction printed by the thermal printer in Embodiment 2. FIG. 10A is a graph showing an example of the change of the power supplied to the thermal head with printing location in the first direction while only the image is printed by the thermal printer in Embodiment 2. FIG. 10B is a graph showing an example of the change of the power supplied to the thermal head with printing location in the first direction while only the images-for-correction are printed by the thermal printer in Embodiment 2. FIG. 10C is a graph showing an example of the change of the power supplied to the thermal head with printing location in the first direction while the combined image including the image and the images-for-correction is printed by the thermal printer in Embodiment 2. In each of FIGS. 10A, 10B, and 10C, the vertical axis represents the printing location in the first direction, and the horizontal axis represents the power P supplied to the thermal head. The power P supplied to the thermal head is the power supplied to the thermal head while each line extending in the second direction is printed.

The image I1 illustrated in FIG. 9A is similar to the image I1 illustrated in FIG. 5A.

The change of the power P supplied to the thermal head 132 with printing location in the first direction D1 while only the image I1 is printed as illustrated in FIG. 10A is similar to the change of the power P supplied to the thermal head 132 with printing location in the first direction D1 while only the image I1 is printed as illustrated in FIG. 6A.

The images-for-correction I2 included in the combined image I illustrated in FIG. 9B include regions RA', RB', and RC'.

The regions RA', RB', and RC' are located in ranges different in the first direction D1, and are located in the second direction D2 as viewed from the regions RA, RB, and RC.

The region RA' includes the regions RA4 and RA5 each having a relatively high density.

The region RB' includes the regions RB4 and RB5 each having a relatively low density.

The region RC' includes the regions RC4 and RC5 each having a relatively high density.

With these configurations, printing is performed simultaneously in the region RA of the image I1 having a relatively low density and in the region RA' of the images-for-correction I2 having a relatively high density. Printing is also performed simultaneously in the region RB of the image I1 having a relatively high density and in the region RB' of the images-for-correction I2 having a relatively low density. Printing is also performed simultaneously in the region RC of the image I1 having a relatively low density and in the region RC' of the images-for-correction I2 having a relatively high density. The change of the power P supplied to the thermal head 132 with printing location in the first direction D1 while the image I1 and the images-for-correction I2 are printed is thereby reduced.

The regions RA4 and RA5 each have a printing range W in the second direction D2 continuously changing with printing location in the first direction D1 to become wider with decreasing distance from the regions RB4 and RB5. The regions RC4 and RC5 each have a printing range W in the second direction D2 continuously changing with printing location in the first direction D1 to become wider with decreasing distance from the regions RB4 and RB5.

In the change of the power P supplied to the thermal head 132 with printing location in the first direction D1 while only the images-for-correction I2 are printed as illustrated in FIG. 10B, the power P supplied to the thermal head 132 is relatively large in the ranges RNA and RNC in which printing is performed in the regions RA' and RC' respectively, and is relatively small in the range RNB in which printing is performed in the region RB'. In the ranges RNA and RNC, the power P supplied to the thermal head 132 increases with decreasing distance from the range RNB.

The change of the power P supplied to the thermal head 132 with printing location in the first direction D1 while the combined image I is printed as illustrated in FIG. 10C is the sum of the change of the power P supplied to the thermal head 132 with printing location in the first direction D1 while only the image I1 is printed as illustrated in FIG. 10A and the change of the power P supplied to the thermal head 132 with printing location in the first direction D1 while only the images-for-correction I2 are printed as illustrated in FIG. 10B. In the change of the power P supplied to the thermal head 132 with printing location in the first direction D1 while the combined image I is printed as illustrated in FIG. 10C, the power P supplied to the thermal head 132 is not constant, but the change of the power P supplied to the thermal head 132 is reduced at the boundary between the ranges RNA and RNB and at the boundary between the ranges RNB and RNC.

The created printing-data-for-correction and the printed images-for-correction may be changed as long as the first change of the power P supplied to the thermal head 132 with printing location in the first direction D1 while the combined image I is printed onto the paper 111 becomes smaller than the second change of the power P supplied to the thermal head 132 with printing location in the first direction D1 while only the image I1 is printed onto the paper 111. One example of the change is described in "2. 3 Modification of Embodiment 2" below.

2.2 Effects of Invention in Embodiment 2

According to the invention in Embodiment 2, the change of the power P supplied to the thermal head 132 while the image I1 is printed is reduced as with the invention in Embodiment 1. The printing defect caused by the increase in change of the power P supplied to the thermal head 132 can thereby be suppressed.

According to the invention in Embodiment 2, it is unnecessary to correct the printing data itself to suppress the printing defect as with the invention in Embodiment 1. The adverse effects of correction to suppress the printing defect on the quality of the image I1 printed using the printing data can thereby be suppressed.

Furthermore, according to the invention in Embodiment 2, power required for correction to suppress the printing defect can be reduced compared with that in the invention in Embodiment 1.

2.3 Modification of Embodiment 2

Figure 11:
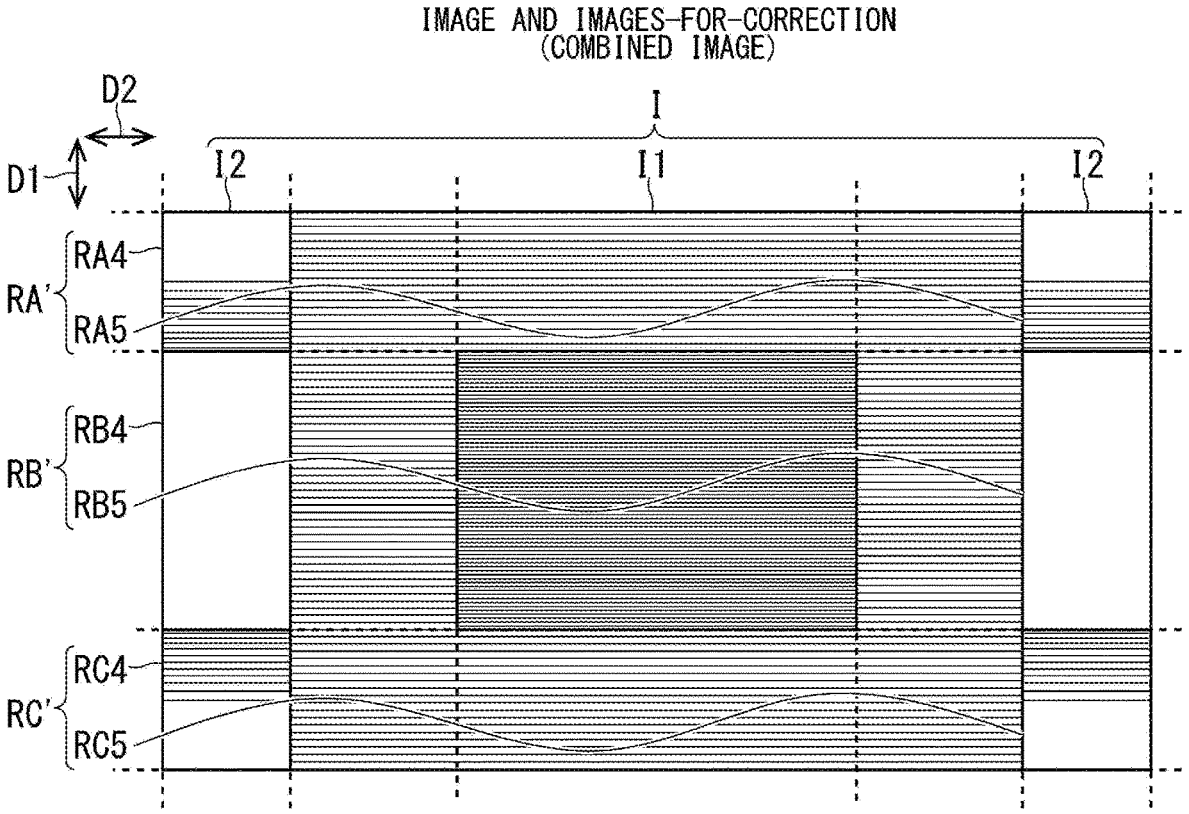
FIG. 11 illustrates an example of a combined image printed by a thermal printer in a modification of Embodiment 2.
Figure 12A:
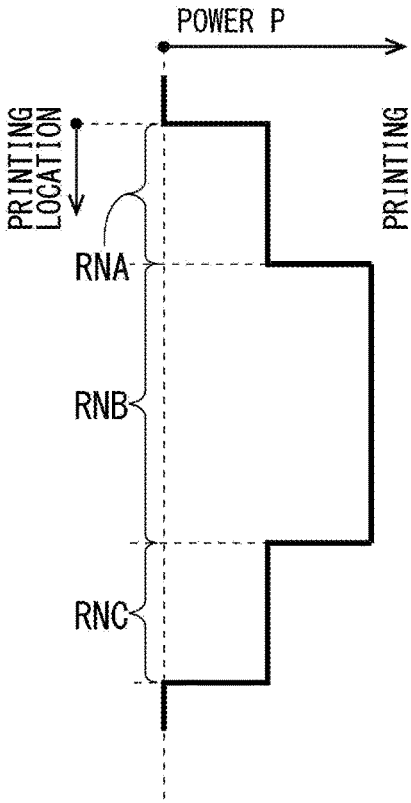
FIG. 12A shows a graph showing an example of the change of the power supplied to the thermal head with printing location in the first direction while an image is printed by the thermal printer in the modification of Embodiment 2.
Figure 12B:
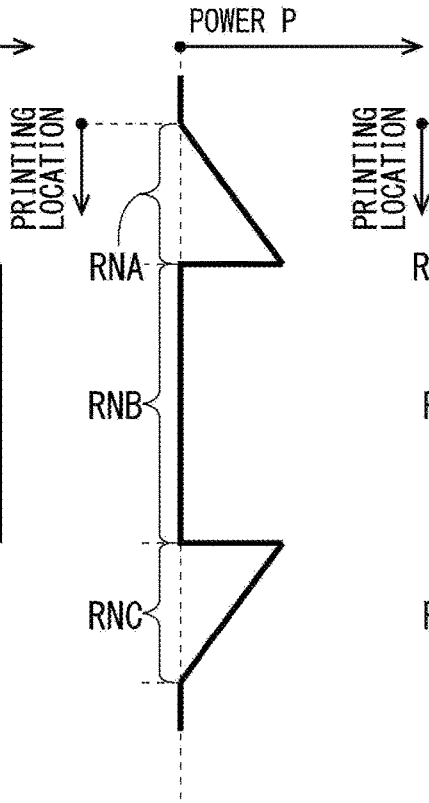
FIG. 12B shows a graph showing an example of the change of the power supplied to the thermal head with printing location in the first direction while images-for-correction are printed by the thermal printer in the modification of Embodiment 2.
Figure 12C:
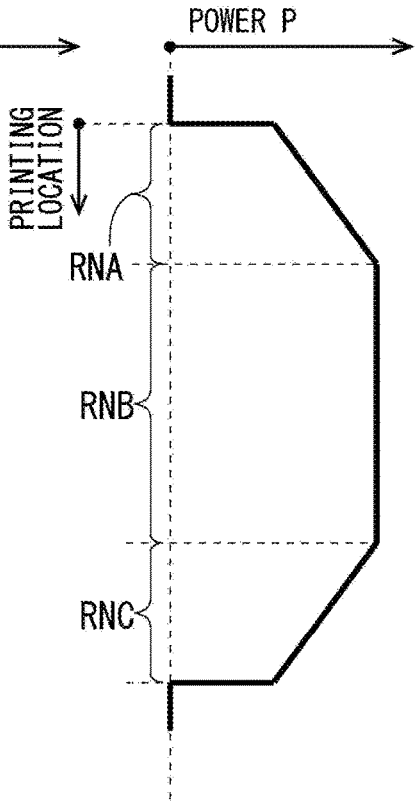
FIG. 12C shows a graph showing an example of the change of the power supplied to the thermal head with printing location in the first direction while the combined image is printed by the thermal printer in the modification of Embodiment 2.

FIG. 11 illustrates an example of a combined image including an image and images-for-correction printed by a thermal printer in a modification of Embodiment 2. FIG. 12A is a graph showing an example of the change of the power supplied to the thermal head with printing location in the first direction while only the image is printed by the thermal printer in the modification of Embodiment 2. FIG. 12B is a graph showing an example of the change of the power supplied to the thermal head with printing location in the first direction while only the images-for-correction are printed by the thermal printer in the modification of Embodiment 2. FIG. 12C is a graph showing an example of the change of the power supplied to the thermal head with printing location in the first direction while the combined image including the image and the images-for-correction is printed by the thermal printer in the modification of Embodiment 2.

In the images-for-correction I2 included in the combined image I illustrated in FIG. 11, the regions RA4 and RA5 each have a density continuously changing with printing location in the first direction D1 to become higher with decreasing distance from the regions RB4 and RB5. The regions RC4 and RC5 each have a density continuously changing with printing location in the first direction D1 to become higher with decreasing distance from the regions RB4 and RB5.

In the change of the power P supplied to the thermal head 132 with printing location in the first direction D1 while only the images-for-correction I2 are printed as illustrated in FIG. 12B, the power P supplied to the thermal head 132 is relatively large in the ranges RNA and RNC in which printing is performed in the regions RA' and RC', and is relatively small in the range RNB in which printing is performed in the region RB'. In the ranges RNA and RNC, the power P supplied to the thermal head 132 increases with decreasing distance from the range RNB.

In the change of the power P supplied to the thermal head 132 with printing location in the first direction D1 while the combined image I is printed as illustrated in FIG. 12C, the power P supplied to the thermal head 132 is not constant, but the change of the power P supplied to the thermal head 132 is reduced at the boundary between the ranges RNA and RNB and at the boundary between the ranges RNB and RNC.

2.4 Effects of Invention in Modification of Embodiment 2

According to the invention in the modification of Embodiment 2, the change of the power P supplied to the thermal head 132 while the image I1 is printed is reduced as with the invention in Embodiment 1. The printing defect caused by the increase in change of the power P supplied to the thermal head 132 can thereby be suppressed.

According to the invention in the modification of Embodiment 2, it is unnecessary to correct the printing data itself to suppress the printing defect as with the invention in Embodiment 1. The adverse effects of correction to suppress the printing defect on the quality of the image I1 printed using the printing data can thereby be suppressed.

According to the invention in the modification of Embodiment 2, the power required for correction to suppress the printing defect can be reduced compared with that in the invention in Embodiment 1.

Furthermore, according to the invention in the modification of Embodiment 2, non-uniform distribution of tension associated with thermal shrinkage of the ink sheet 121 when the images-for-correction I2 are printed can be suppressed, so that a printing defect, such as wrinkles, can be suppressed.

3 Embodiment 3

3.1 Difference Between Embodiments 2 and 3

FIG. 1 is also a schematic view schematically illustrating a printing mechanism of a thermal printer in Embodiment 3. FIG. 2 is also a block diagram showing a control system of the thermal printer in Embodiment 3. FIG. 3 is also a schematic view schematically illustrating a thermal head of the thermal printer in Embodiment 3. FIG. 4 is also a block diagram showing a printing data processing unit, the thermal head, and a power supply unit of the thermal printer in Embodiment 3.

Embodiment 3 differs from Embodiment 2 mainly in configuration described below. As for configuration not described below, similar configuration to that used in Embodiment 2 is used in Embodiment 3.

Figure 13:
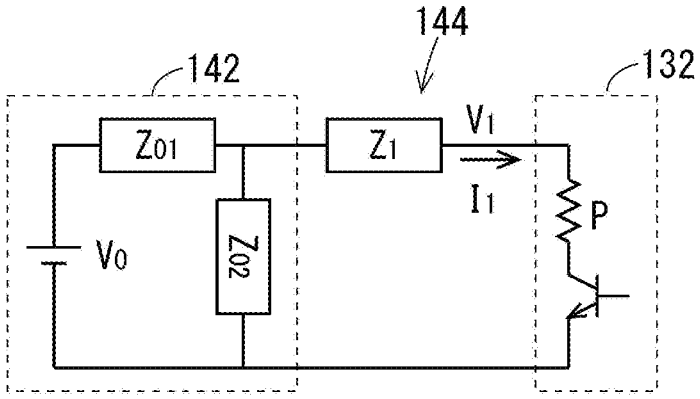
FIG. 13 is a circuit diagram showing an equivalent circuit of a power supply unit, a wiring path, and the thermal head of the thermal printer in Embodiment 3.

FIG. 13 is a circuit diagram showing an equivalent circuit of the power supply unit, a wiring path, and the thermal head of the thermal printer in Embodiment 3.

As shown in FIG. 13, the power supply unit 142 has a power supply voltage $V_0$ and output impedances $Z_{01}$ and $Z_{02}$. A wiring path 144 from the power supply unit 142 to the thermal head 132 has a path impedance $Z_1$. The power P supplied to the thermal head 132 is given by a voltage $V_1$ supplied to the thermal head 132 and a current $I_1$ supplied to the thermal head 132.

Impedance Z is generally expressed by an equation (1) using resistance R, inductance L, and capacitance C.

[Math 1]

$$Z = R + jwL + \frac{1}{jwC} \tag{1}$$

The power supply unit 142 has load variation response characteristics determined by the output impedances $Z_{01}$ and $Z_{02}$ and the path impedance $Z_1$.

Figure 14A:
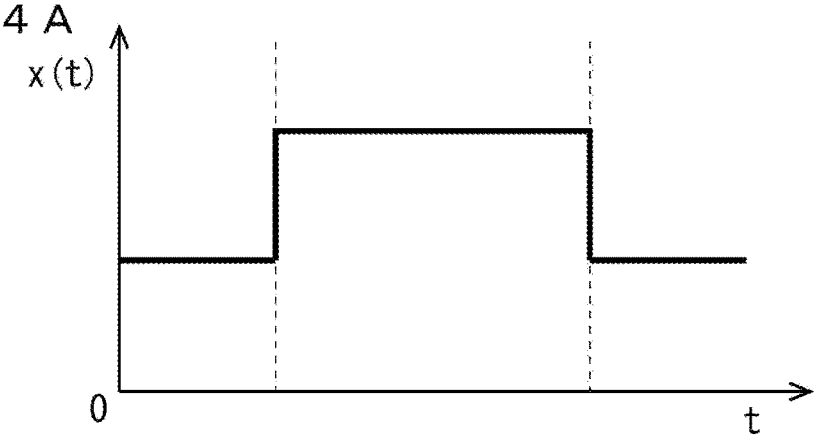
FIG. 14A shows a graph showing an example of a temporal change of printing data x(t) in the thermal printer in Embodiment 3.
Figure 14B:
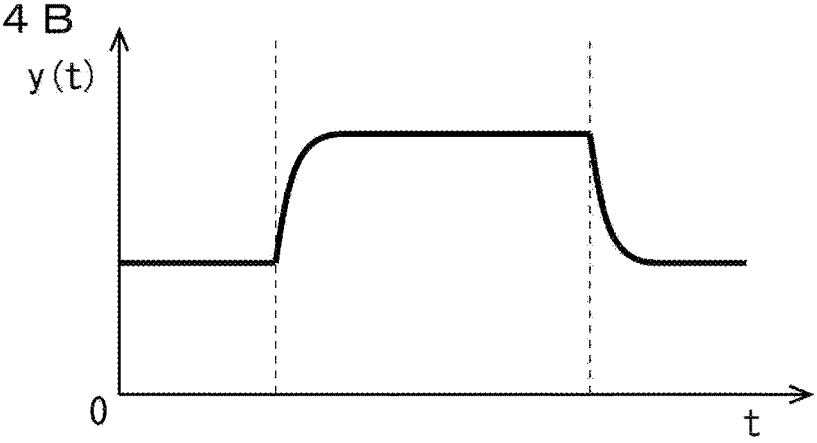
FIG. 14B shows a graph showing an example of a temporal change of power y(t) in the thermal printer in Embodiment 3.
Figure 14C:
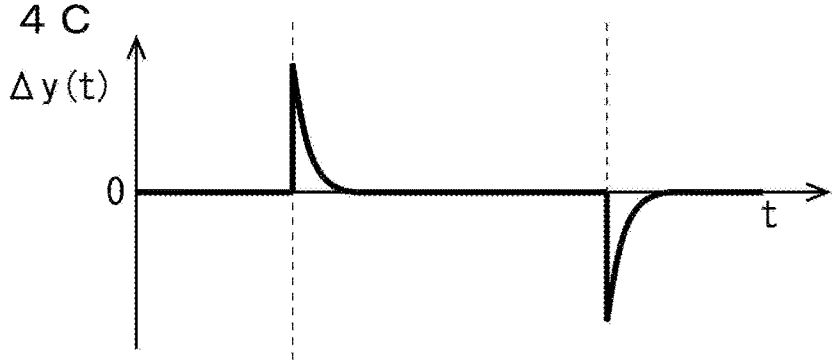
FIG. 14C shows a graph showing an example of a temporal change of a difference $\Delta y(t)$ in the thermal printer in Embodiment 3.
Figure 14D:
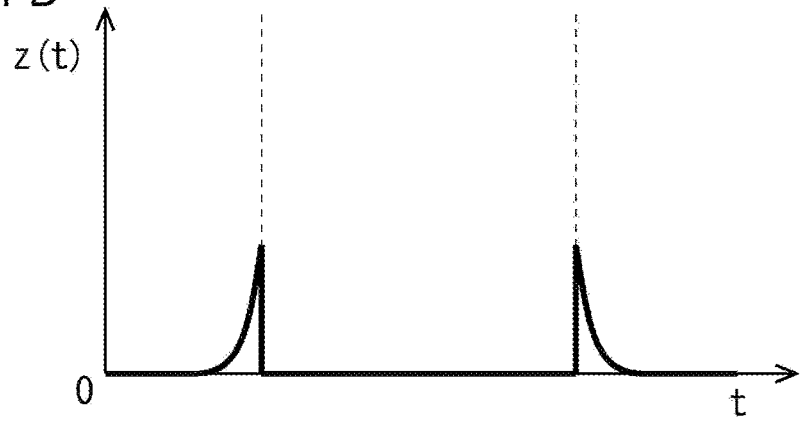
FIG. 14D shows a graph showing an example of a temporal change of a correction value z(t) in the thermal printer in Embodiment 3.

FIG. 14A is a graph showing an example of a temporal change of printing data x(t) used in the thermal printer in Embodiment 3. FIG. 14B is a graph showing an example of a temporal change of power y(t) supplied to the thermal head calculated in the thermal printer in Embodiment 3. FIG. 14C is a graph showing a temporal change of a difference Δy(t) between the printing data x(t) used in the thermal printer in Embodiment 3 and the power P y(t) supplied to the thermal head calculated in the thermal printer in Embodiment 3. FIG. 14D is a graph showing an example of a temporal change of a correction value z(t) acquired to create the printing-data-for-correction in the thermal printer in Embodiment 3.

In Embodiment 3, the printing-data-for-correction creation unit 192 creates the printing-data-for-correction based on the load variation response characteristics of the power supply unit 142. In this case, the printing-data-for-correction creation unit 192 creates the printing-data-for-correction to cause the change of the power P with printing location in the first direction D1 while the combined image I including the image I1 and the images-for-correction I2 is printed onto the paper 111 to be achieved by the load variation response characteristics of the power supply unit 142.

When creating the printing-data-for-correction, the printing-data-for-correction creation unit 192 acquires the correction value based on the load variation response characteristics of the power supply unit 142, and creates the printing-data-for-correction based on the acquired correction value.

In a case where the image I1 is printed using the printing data x(t) shown in FIG. 14A, for example, the power y(t) shown in FIG. 14B is acquired based on the load variation response characteristics of the power supply unit 142. The difference Δy(t) shown in FIG. 14C is acquired from the used printing data x(t) and the acquired power y(t). The correction value z(t) shown in FIG. 14D is acquired from the acquired difference Δy(t).

Figure 15:
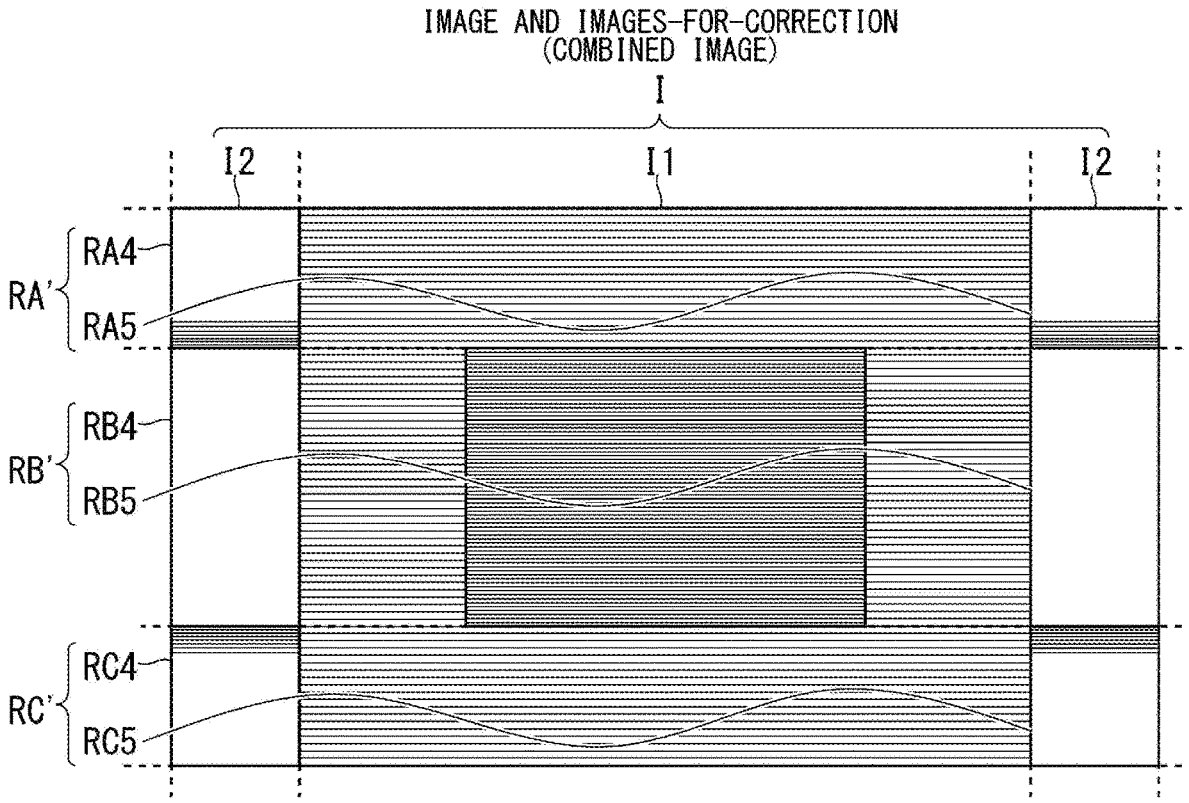
FIG. 15 illustrates an example of images-for-correction printed by the thermal printer in Embodiment 3.
Figure 16A:
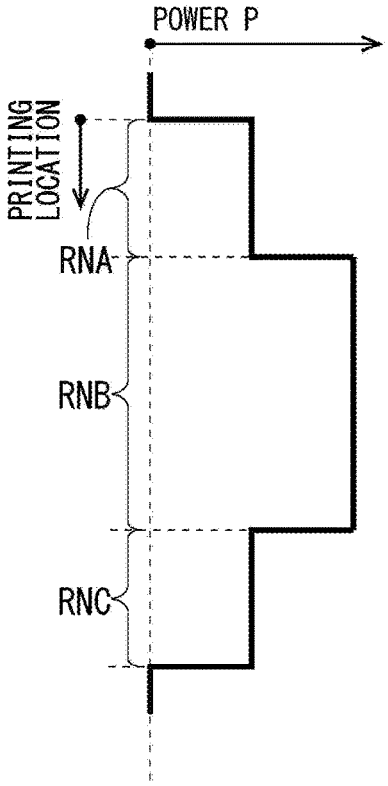
FIG. 16A shows a graph showing an example of the change of the power supplied to the thermal head with printing location in the first direction while an image is printed by the thermal printer in Embodiment 3.
Figure 16B:
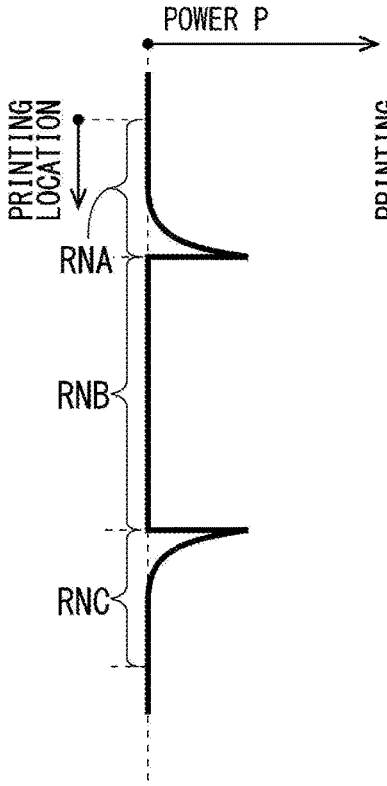
FIG. 16B shows a graph showing an example of the change of the power supplied to the thermal head with printing location in the first direction while the images-for-correction are printed by the thermal printer in Embodiment 3.
Figure 16C:
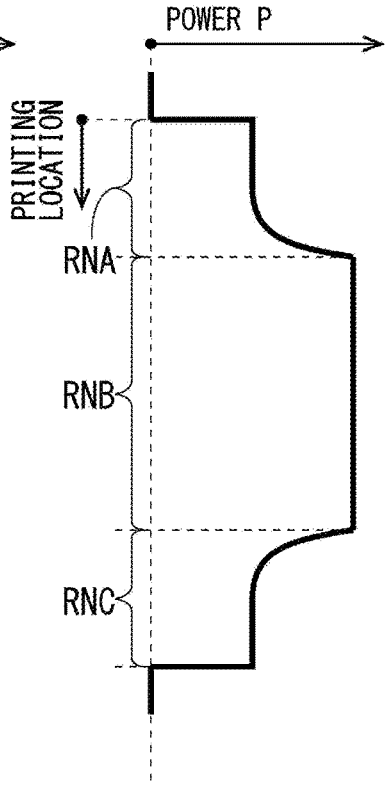
FIG. 16C shows a graph showing an example of the change of the power supplied to the thermal head with printing location in the first direction while a combined image is printed by the thermal printer in Embodiment 3.

FIG. 15 illustrates an example of the combined image including the image and the images-for-correction printed by the thermal printer in Embodiment 3. FIG. 16A is a graph showing an example of the change of the power supplied to the thermal head with printing location in the first direction while only the image is printed by the thermal printer in Embodiment 3. FIG. 16B is a graph showing an example of the change of the power supplied to the thermal head with printing location in the first direction while only the images-for-correction are printed by the thermal printer in Embodiment 3. FIG. 16C is a graph showing an example of the change of the power supplied to the thermal head with printing location in the first direction while the combined image including the image and the images-for-correction is printed by the thermal printer in Embodiment 3.

In the images-for-correction I2 included in the combined image I illustrated in FIG. 15, the regions RA4 and RA5 each have a density continuously changing with printing location in the first direction D1 to become higher with decreasing distance from the regions RB4 and RB5. The regions RC4 and RC5 each have a density continuously changing with printing location in the first direction D1 to become higher with decreasing distance from the regions RB4 and RB5.

In the change of the power P supplied to the thermal head 132 with printing location in the first direction D1 while only the images-for-correction I2 are printed as illustrated in FIG. 16B, the power P supplied to the thermal head 132 is relatively large in the ranges RNA and RNC in which printing is performed in the regions RA' and RC', and is relatively small in the range RNB in which printing is performed in the region RB'. In the ranges RNA and RNC, the power P supplied to the thermal head 132 increases with decreasing distance from the range RNB.

In the change of the power P supplied to the thermal head 132 with printing location in the first direction D1 while the combined image I is printed as illustrated in FIG. 16C, the power P supplied to the thermal head 132 is not constant, but the change of the power P supplied to the thermal head 132 is reduced at the boundary between the ranges RNA and RNB and at the boundary between the ranges RNB and RNC.

Figure 17:
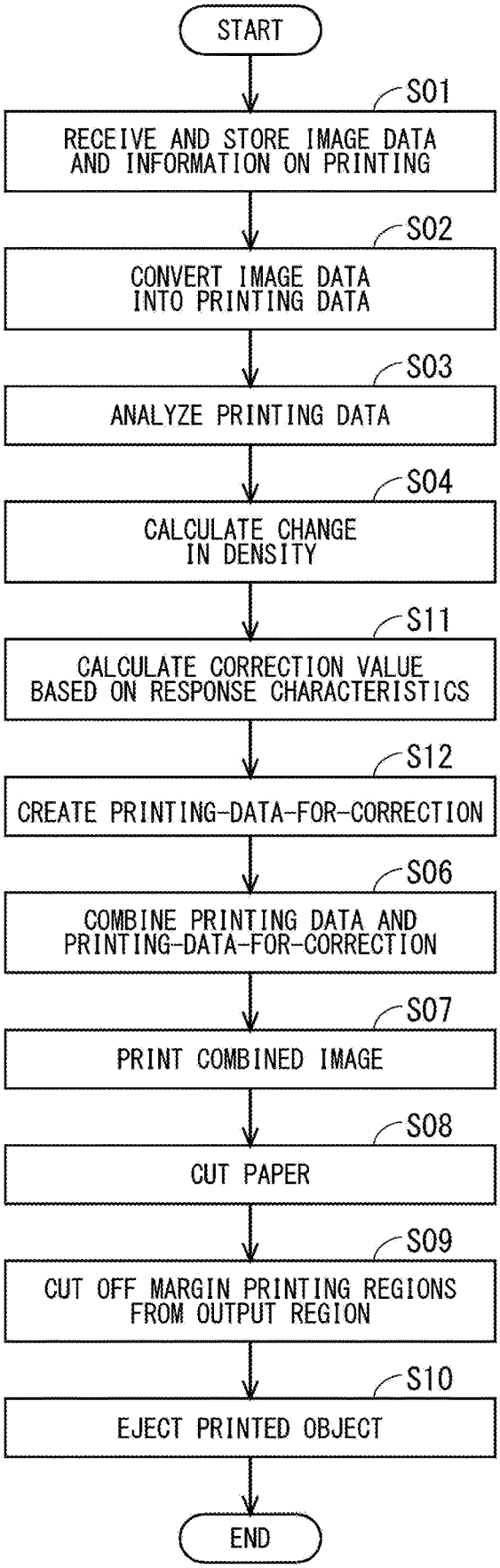
FIG. 17 is a flowchart showing operation of the thermal printer in Embodiment 3.

FIG. 17 is a flowchart showing operation of the thermal printer in Embodiment 3.

The thermal printer 1 sequentially performs the steps S01 to S04, steps S11 to S12, and the steps S06 to S10 shown in FIG. 17 when performing printing onto the paper 111.

In the steps S01 to S04 shown in FIG. 17, similar processing to that performed in the steps S01 to S04 shown in FIG. 7 is performed.

In the step S11, the printing-data-for-correction creation unit 192 calculates the correction value based on the calculated change in density. When calculating the correction value, the printing-data-for-correction creation unit 192 calculates the correction value based on the load variation response characteristics of the power supply unit 142.

In the step S12, the printing-data-for-correction creation unit 192 creates the printing-data-for-correction to be used to print the images-for-correction I2 based on the calculated correction value.

In the steps S06 to S10 shown in FIG. 17, similar processing to that performed in the steps S06 to S10 shown in FIG. 7 is performed.

3.2 Effects of Invention in Embodiment 3

According to the invention in Embodiment 3, the change of the power P supplied to the thermal head 132 while the image I1 is printed is reduced as with the invention in Embodiment 2. The printing defect caused by the increase in change of the power P supplied to the thermal head 132 can thereby be suppressed.

According to the invention in Embodiment 3, it is unnecessary to correct the printing data itself to suppress the printing defect as with the invention in Embodiment 2. The adverse effects of correction to suppress the printing defect on the quality of the image I1 printed using the printing data can thereby be suppressed.

Furthermore, according to the invention in Embodiment 3, the power required for correction to suppress the printing defect can be reduced compared with that in the invention in Embodiment 1 as with the invention in Embodiment 2.

Embodiments of the present invention can freely be combined with each other, and can be modified or omitted as appropriate within the scope of the invention.

While the invention has been described in detail, the foregoing description is in all aspects illustrative and not restrictive. It is understood that numerous modifications not having been described can be devised without departing from the scope of the present invention.

EXPLANATION OF REFERENCE SIGNS

1 thermal printer, 111 paper, 121 ink sheet, 131 paper carrier, 132 thermal head, 136 slitter, 142 power supply unit, 161 printed object, 171 output region, 172 margin printing regions, 191 density change calculation unit, 192 printing-data-for-correction creation unit, I combined image, I1 image, and I2 images-for-correction.

The invention claimed is:

1. A thermal printer comprising:

a paper carrier to carry paper in a first direction;

a thermal head to convert power into heat, and heat an ink sheet laid on the paper by the heat;

a density change calculation unit to calculate, using printing data, a change in density in the first direction of an image to be printed in an output region of the paper remaining in a printed object to be output; and a printing-data-for-correction creation unit to create, based on the change in density, printing-data-for-correction to be used to print an image-for-correction in a margin printing region of the paper not remaining in the printed object and to cause a first change of the power with printing location in the first direction while a combined image including the image and the image-for-correction is printed onto the paper to be smaller than a second change of the power with printing location in the first direction while the image is printed onto the paper, wherein the thermal head heats the ink sheet in accordance with the printing data and the printing-data-for-correction.

2. The thermal printer according to claim 1, wherein the margin printing region is located in a second direction perpendicular to the first direction as viewed from the output region.

3. The thermal printer according to claim 1, further comprising a slitter to cut off the margin printing region from the output region.

4. The thermal printer according to claim 1, wherein causing the first change to be smaller than the second change is maintaining the power while the combined image is printed onto the paper constant.

5. The thermal printer according to claim 1, further comprising a power supply unit to supply the power, wherein causing the first change to be smaller than the second change includes causing the first change to be achieved by load variation response characteristics of the power supply unit.

6. The thermal printer according to claim 5, wherein the printing-data-for-correction creation unit creates the printing-data-for-correction based on the response characteristics.

7. The thermal printer according to claim 1, wherein the image-for-correction includes a region having a printing range in a second direction perpendicular to the first direction, the printing range continuously changing with location in the first direction.

8. The thermal printer according to claim 1, wherein the image-for-correction includes a region having a density continuously changing with location in the first direction.

9. A printing method comprising:

a) carrying paper in a first direction;

b) converting power into heat, and heating an ink sheet laid on the paper by the heat;

c) calculating, using printing data, a change in density in the first direction of an image to be printed in an output region of the paper remaining in a printed object to be output; and d) creating, based on the change in density, printing-data-for-correction to be used to print an image-for-correction in a margin printing region of the paper not remaining in the printed object and to cause a first change of the power with printing location in the first direction while a combined image including the image and the image-for-correction is printed onto the paper to be smaller than a second change of the power with printing location in the first direction while the image is printed onto the paper, wherein in the step b), the ink sheet is heated in accordance with the printing data and the printing-data-for-correction.

* * * * *